United States Patent [19]

Kropiwka

[11] 4,037,542

[45] July 26, 1977

[54] AUXILIARY SHELF APPARATUS

[76] Inventor: Thomas Kropiwka, 715 4th Ave., NW., New Brighton, Minn. 55112

[21] Appl. No.: 688,362

[22] Filed: May 20, 1976

[51] Int. Cl.[2] ..... A47B 41/04

[52] U.S. Cl. ..... 108/32

[58] Field of Search ..... 108/102, 108, 134, 111, 108/32, 152; 211/50, 150, 153; 312/322, 323; 248/235, 248, 247, 73, 223

[56] References Cited

U.S. PATENT DOCUMENTS

| | | | |
|---|---|---|---|
| 1,270,718 | 6/1918 | Ford | 248/248 X |
| 2,401,182 | 5/1946 | Paxton et al. | 312/281 |
| 2,731,319 | 1/1956 | Jackobs et al. | 312/328 X |
| 2,943,747 | 7/1960 | Shaw | 248/235 X |
| 3,067,882 | 12/1962 | Ribbins et al. | 108/102 |
| 3,193,108 | 7/1965 | Johnson | 211/153 |
| 3,400,829 | 9/1968 | Youngson | 211/153 X |
| 3,489,382 | 1/1970 | Larson | 248/223 |
| 3,563,394 | 2/1971 | Joyce | 248/223 |
| 3,627,247 | 12/1971 | Krikorian | 108/108 X |

*Primary Examiner*—James T. McCall
*Attorney, Agent, or Firm*—Norman P. Friederichs

[57] ABSTRACT

An auxiliary shelf apparatus positionable with respect to the outer edge of a shelf for providing an extension of the shelf surface onto which file boxes stored on the shelf can be pulled and there supported for inspection of contents. A tray surface is provided with a support bracket which engages the shelf upon which the file box is stored and the next-above shelf to support the tray surface in generally flush alignment with the shelf. The support bracket is adjustable to fit shelving having various spacings between shelves. The auxiliary shelf apparatus is disengageable from the shelving so that it may be readily movable to different locations on the shelving.

7 Claims, 7 Drawing Figures

FIG. 3
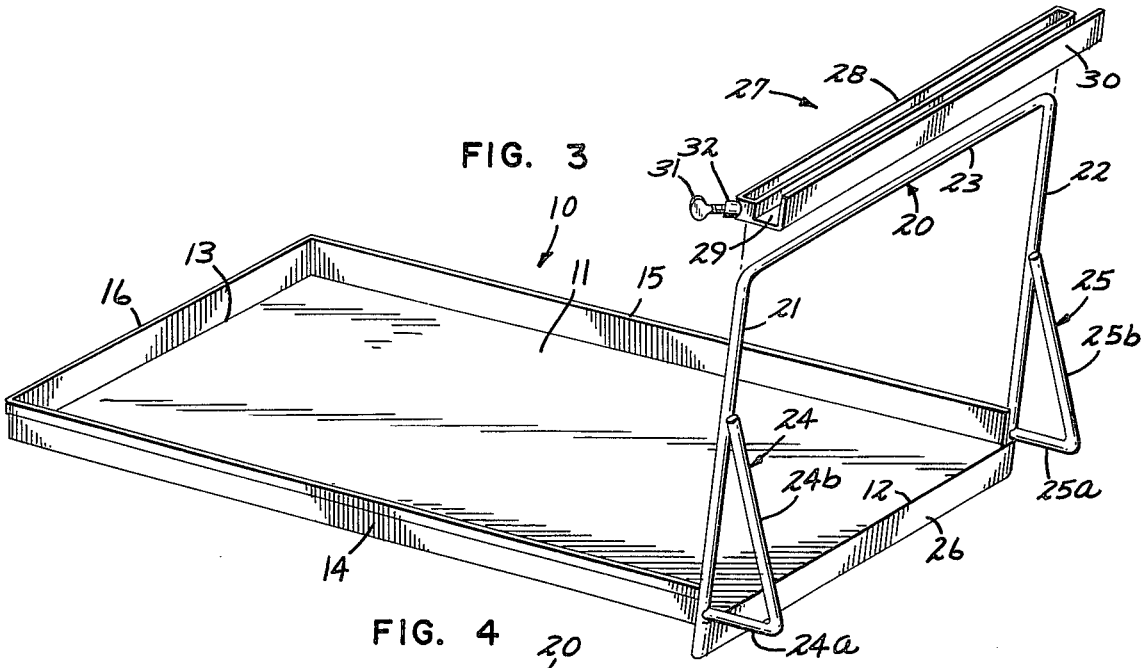
FIG. 4
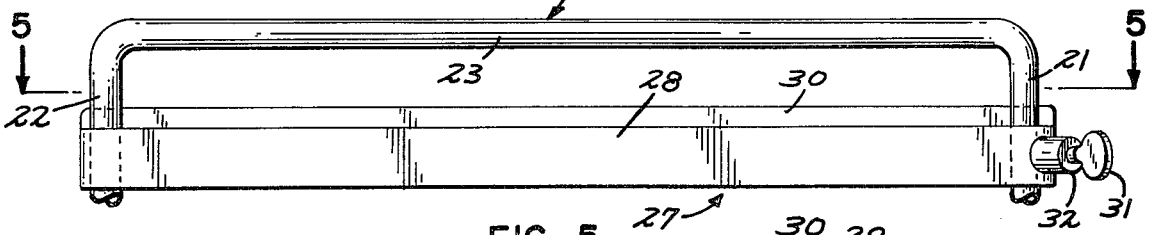
FIG. 5
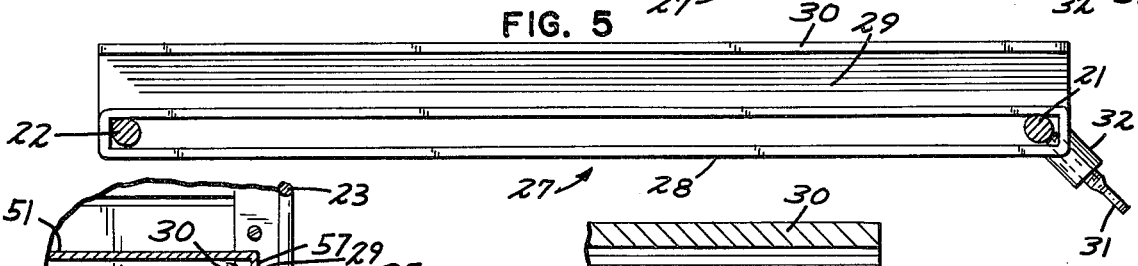
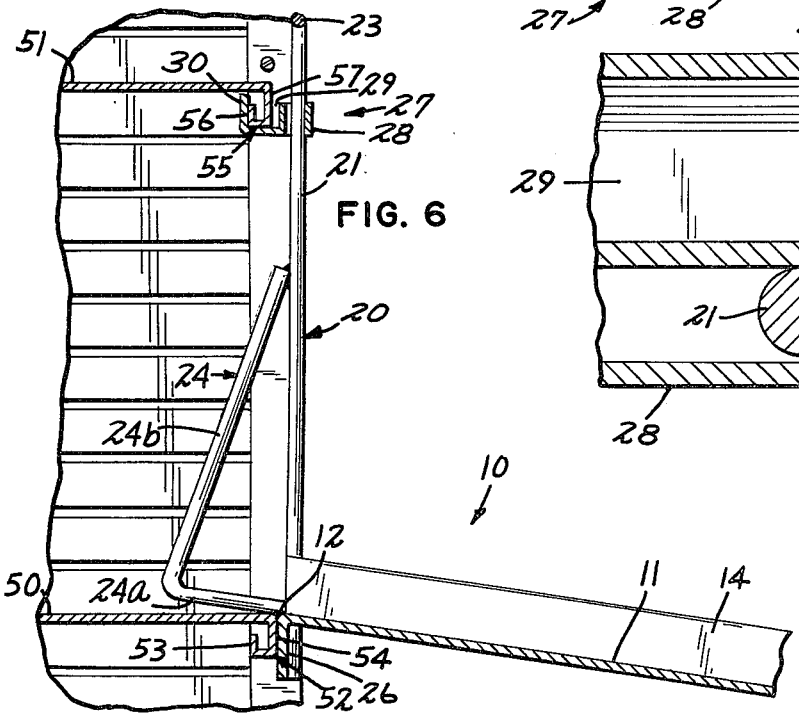
FIG. 6
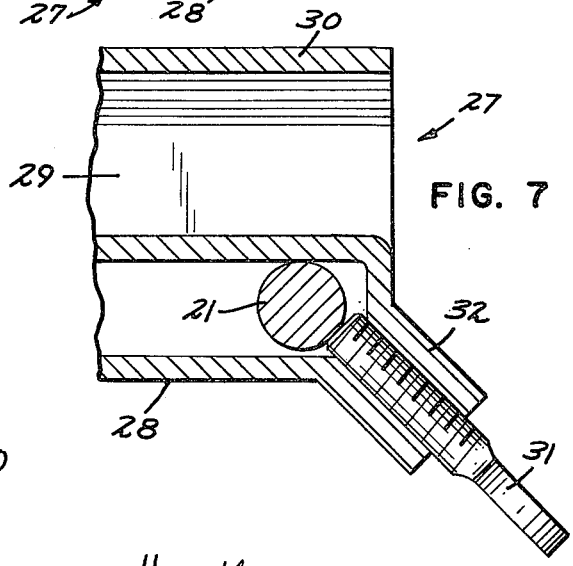
FIG. 7

AUXILIARY SHELF APPARATUS

BACKGROUND OF THE INVENTION

1. Field of the Invention

This invention relates to an auxiliary shelf apparatus for use in conjunction with shelving of the type having a plurality of shelves vertically spaced apart from each other in a rack-type arrangement. The apparatus of this invention provides an extension for a shelf surface onto which material stored on the shelf can be pulled for easy inspection.

2. Description of the Prior Art

The storage of business records has long been a problem for business. In order to make effective use of available space, records have been stored in covered filing boxes and placed on shelves. The shelves in turn have been located on above another in rack-type shelving frames in order to minimize the space required. Such shelving typically extends from the floor to a point near the ceiling. In order to inspect records contained on upper shelves, a ladder is often required. The distance between shelves is usually only slightly greater than the height of the filing boxes themselves. In order to inspect the contents of a filing box, it must be removed from the shelf so that the cover can be removed and the contents reached. When the box is full, and therefore heavy, it must be lifted from the shelf and placed upon a support, such as a table or desk, before the contents can be examined. This requires a considerable expenditure of time and effort, particularly if the box is any great height above the floor.

To solve these problems, various types of shelving adaptors have been developed. But, for one reason or another, these have all proved unsatisfactory. Some require rigid attachment to the shelving. Others can be used in conjunction with only certain types of shelving. These prior art devices have proved unsatisfactory due to their lack of adaptability to various types of shelving.

SUMMARY OF THE INVENTION

The present invention solves the problems associated with the prior art devices. The auxiliary shelf apparatus is designed to be used with conventional shelving having downwardly projecting lips. It is also designed to be readily disengageable from the shelving and readily re-engageable to the shelving to another point.

To the above ends, the auxiliary shelf apparatus is provided with a tray surface attached at its rear end to a support bracket to hold the tray surface in flush alignment with the top surface of a shelf. The support bracket includes a pair of main support members extending generally perpendicular to the tray surface and in a vertical upward direction when the auxiliary shelf apparatus engages the shelving. A pair of auxiliary support members are attached to the pair of main support members and extend rearward of the tray surface. The auxiliary support members are positioned so that the lower surface of each is approximately coplanar with the tray surface and rests upon the surface of a shelf when the auxiliary shelf apparatus is placed in position. The auxiliary shelf apparatus is thus provided with supports against vertical movement relative to the shelf surface and maintained in flush alignment with the shelf surface.

The support bracket also includes a transverse support member extending perpendicularly to the tray surface and in a vertical downward direction when the auxiliary shelf apparatus engages the shelving. The transverse support member, when the auxiliary shelf surface is in position, abuts the front surface of the downwardly projecting lip of the shelf and thus provides support in the horizontal direction for the auxiliary shelf apparatus to prevent its movement toward the shelf.

The auxiliary shelf apparatus is also provided with means associated with the main support members for engaging from behind the downwardly projecting lip of the shelf immediately above that with which the tray surface is maintained in flush alignment. These means prevent pivotal movement of the tray surface about its rear end. In one embodiment, these means take the form of a connector attached to the top of each main support member, but the end portion of the main support members alone would suffice. In another embodiment, these means take the form of an adaptor which consists of a collar and a flange connected to the collar and spaced apart therefrom to form a channel to receive the lip. In either case, an element attached to the main support member abuts the interior surface of the lip and thus supports the tray surface against downward pivotal movement about its rear end.

BRIEF DESCRIPTION OF THE DRAWINGS

FIG. 3 is a view in perspective of an auxiliary shelf apparatus and an adaptor;

FIG. 4 is a fragmentary view in front elevation of an adaptor positioned in conjunction with the main support members of an auxiliary shelf apparatus;

FIG. 5 is a view in top plan of an adaptor taken along the plane of the line 5—5 of FIG. 4;

FIG. 6 is a sectional view in side elevation of an auxiliary shelf apparatus in conjunction with an adaptor engaged with shelving; and FIG. 7 is a fragmentary sectional view of a thumb screw for realeasably engaging the adaptor with the main support members.

DETAILED DESCRIPTION OF THE DRAWINGS

Figure 1:
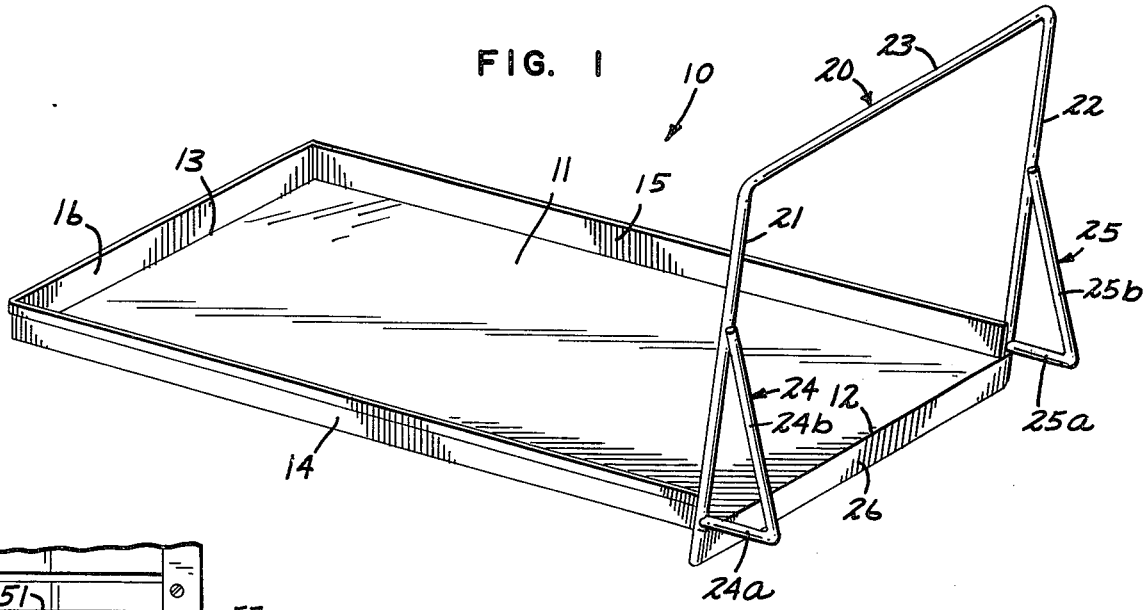
FIG. 1 is a view in perspective of an auxiliary shelf apparatus.

Referring to the figures, wherein like numbers represent like elements, the auxiliary shelf apparatus is generally designated 10. The auxiliary shelf apparatus 10 is provided with a tray surface 11 having a rear end 12 and a front end 13. It is contemplated that the auxiliary shelf apparatus 10 be fabricated from a metal sheet, but any other material having suitable strength may be used.

The tray surface 11 has barriers 14, 15 and 16 extending vertically upward from its two sides and front end 13, respectively. The barriers 14, 15 and 16 prevent file boxes placed on the tray surface 11 from being pulled off the tray surface 11 accidentally. The barriers 14, 15 and 16 also add strength to the tray surface 11 and prevent its deformation under the weight of the file boxes. The top portion of each barrier 14, 15 and 16 is folded over to the outside to give additional strength and as a safety factor to remove the sharp edges of the barriers 14, 15 and 16 to a position where they are less likely to cause injuries. The barrier 16 located at the front end 13 extends across the entire front end 13. The barriers 14 and 15 located on the sides of the tray surface 11 extend from the front end 13 to the rear end 12.

A support bracket, generally designated as 20, is attached to the tray surface 11 at its rear end 12. The support bracket 20 includes first and second main support members 21 and 22, respectively. Main support members 21 and 22 are attached by means of welding to opposite sides of the rear end 12. The main support members 21 and 22 are connected across their top portions by a connector 23. In the preferred embodiment, it is contemplated that the main support members 21 and 22 and the connector 23 be formed from a rod bent so that the end portions are parallel to each other and perpendicular to the middle portion, but it is understood that each may be a separate piece attached by welding or other suitable means. The connector 23 is not required but is preferred to provide strength to the support bracket 20.

The support bracket 20 also includes first and second auxiliary support members 24 and 25 attached to the main support members 21 and 22, respectively. The auxiliary support members 24 and 25 extend from the rear end 12 in a rearward direction of the tray surface 11. The auxiliary support members 24 and 25 have horizontal portions **24*a* and 25*a* which are attached to the main support members 21 and 22, respectively, at positions such that the bottom surfaces of the horizontal portions 24*a* and 25*a* are approximately coplanar with the tray surface 11. In the preferred embodiment, the auxiliary support members 24 and 25 take the form of angular members having horizontal portions 24*a* and 25*a* attached at one end to the main support members 21 and 22 at points near the tray surface 11 and at the other end to connector members 24*b* and 25*b* which are, in turn, attached to the main support members 21 and 22 at points above the tray surface 11. The connector members 24*b* and 25*b* provide additional strength to the support bracket 20**.

The support bracket 20 further includes a transverse support member 26 which extends from the rear end 12 of the tray surface 11 in a downward direction, perpendicular to the tray surface 11. In the preferred embodiment, it is contemplated that the transverse support member 26 extend across the entire rear end 12 of the tray surface 11. For these purposes, the transverse support member 26 may be the bent-down end of the same sheet of material used to make up the tray surface 11.

Figure 2:
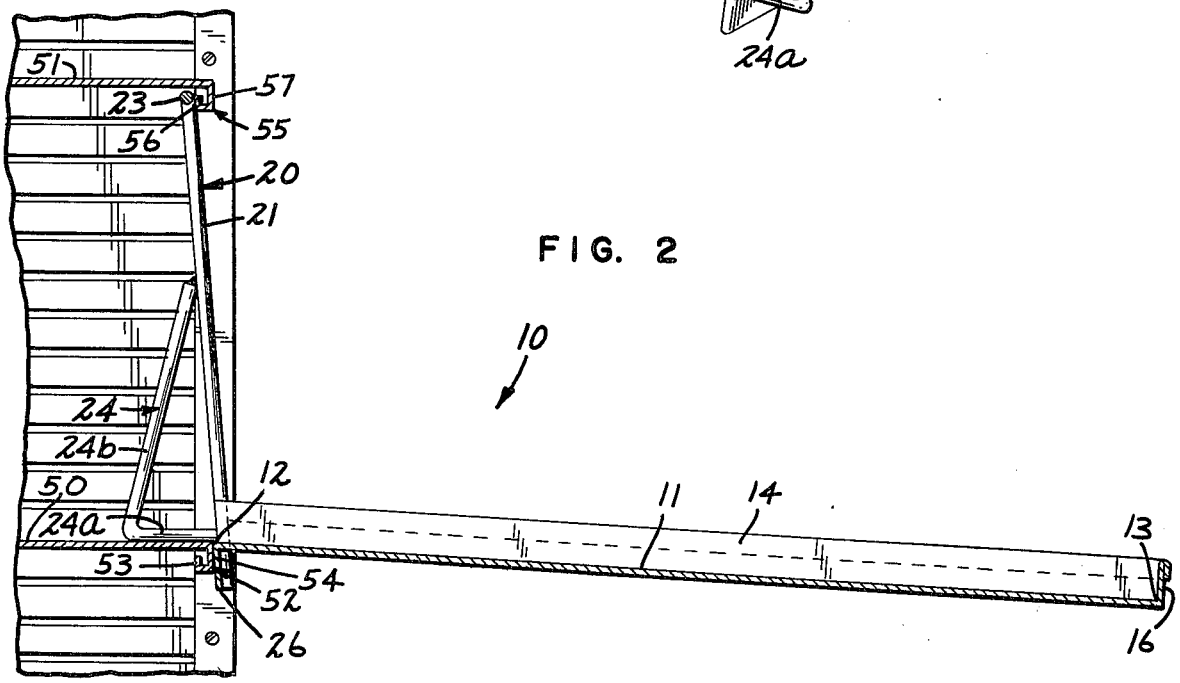
FIG. 2 is a sectional view in side elevation of an auxiliary shelf apparatus engaged with shelving.

In operation, it is contemplated that the auxiliary shelf apparatus 10 be used in conjunction with standard shelving wherein the shelves are vertically spaced apart in rack-type fashion. The auxiliary shelf apparatus is designed so that the tray surface 11 is maintained in flush alignment with a shelf 50 by engagement of the support bracket 20 with the shelf 50 and the next-above shelf 51 (see FIG. 2). The shelves 50 and 51 each have downwardly projecting lips 52 and 55, respectively, which in turn have front surfaces 54 and 57 and rear surfaces 53 and 56, respectively. The auxiliary shelf apparatus 10 is supported against vertical downward movement with respect to the shelf 50 by engagement of the horizontal portions **24*a* and 25*a* of the auxiliary support members 24 and 25 with the shelf 50. The transverse support member 26 abuts the front surface 54 of the lip 52 of the shelf 50 thus supporting the auxiliary shelf apparatus 10 against horizontal movement in the direction of the shelf 50. The upper ends of the main support members 21 and 22 and the connector member 23 abut the rear surface 56 of the lip 55 of the next-above shelf 51 thus supporting the auxiliary shelf apparatus 10 against pivotal downward movement about its rear end 12**.

Due to the fact that the spacing between shelves 50 and 51 may vary, an adapter, generally designated 27 as in FIG. 3, may be used in conjunction with the main support members 21 and 22. The adapter 27 consists of a collar 28 positionable around the main support members 21 and 22 and slidably movable with respect thereto. The length of the collar 28 is only slightly greater than the distance between the main support members 21 and 22 so that the collar 18 is slidably movable only in the vertical direction with respect to the main support members 21 and 22. Attached to the collar 28 is a flange 30. The flange 30 is spaced apart from the collar 28 so as to define a channel 29 therebetween to receive the lip of a shelf.

The collar 28 is releasably positionable at various locations with respect to the main support members 21 and 22. To accomplish this, the collar 28 is provided with a thumb screw 31 adjacent main support member 21 which may be tightened by hand. The thumb screw 31 threadably engages a female thread portion 32 formed in the collar 28. The thumb screw 31 is advanced through the female portion 32 until it abuts the first main support member 21 and thus maintains the collar 28 in fixed position relative to the main support members 21 and 22. Best results are obtained when the thumb screw 31 is set at a 45° angle relative to the line between the main support members 21 and 22. In this manner, when the thumb screw 31 is tightened, it engages the first main support member 21 and at the same time forces tight contact between the second main support member 22 and the collar 28.

In operation, when the adjustable adapter 27 is used, the main support members 21 and 22 are positioned forward of the front surface 57 of the lip 55 of the shelf 51. The lip 55 is positioned in the channel 29 so that the flange 30 engages the rear surface 56 of the lip 55. The auxiliary shelf apparatus 10 is thus supported against pivotal downward movement by the adapter 27 in conjunction with the main support members 21 and 22. The collar 28 may be positioned at any point above the top of the auxiliary support members 24 and 25 to accommodate shelving with different spacing between shelves.

What is claimed is:

1. Auxiliary shelf apparatus for use with shelving of the type having at least a pair of shelves vertically spaced apart from one another in rack-type arrangement, wherein the upper shelf of said pair has formed at its front edge a downwardly projecting lip, said apparatus comprising:

a. tray means having front and rear ends;

b. first support means secured at said rear end of said tray means for detachably engaging the lower shelf of said pair thereby supporting said tray means against vertical downward movement and horizontal movement toward said lower shelf when said first support means engages said shelf, said tray means being supported in substantially flush alignment with said lower shelf; and c. second support means secured to said tray means for detachably engaging the downwardly projecting lip of the upper shelf, said second support means resisting pivotal downward movement about said rear end of said tray means when said second support means engages the downwardly projecting lip of the upper shelf, said second support means permitting the sliding movement of an item from said lower shelf onto said tray means, said auxiliary shelf apparatus being readily attachable and detachable with respect to said pair of shelves.

2. Auxiliary shelf apparatus for use with shelving of the type having a plurality of shelves vertically spaced apart from one another in a rack-type arrangement, wherein each shelf has formed at its front edge a downwardly projecting lip, said apparatus comprising:

a. tray means having front and rear ends;

b. support bracket means attached to one end of said tray means, said support bracket means being capable of supporting said tray means in substantially coplanar relation to a shelf, said support bracket means comprising:

i. first and second main support members extending generally upwardly and perpendicularly from said tray means, said first main support member extending from one side of said rear end of said tray means and said second main support member extending from the other side of said rear end of said tray means, wherein the free ends of said first and second main support members are capable of releasibly engaging a downwardly projecting lip of a shelf;

ii. first and second auxiliary support members extending rearwardly from said rear end of said tray means at a position so that the lower surfaces of said first and second auxiliary support members are generally coplanar with said tray means, said auxiliary support members being capable of resting engagement with the upper surface of a second, next-lower shelf, thereby supporting said tray means on said second shelf in substantially flush alignment with said second shelf; and iii. a transverse support member extending downwardly from said rear end of said tray means in a direction opposite of said first and second main support members; said transverse support member being capable of engaging the front edge of said second shelf to prevent horizontal movement of said tray means toward said second shelf;

said auxiliary shelf apparatus being capable of ready attachment and detachment with respect to said plurality of shelves.

3. Auxiliary shelf apparatus for use with shelving of the type having a plurality of shelves vertically spaced apart from one another in a rack-type arrangement, wherein each shelf has formed at its front edge a downwardly projecting lip, said apparatus comprising:

a. tray means having front and rear ends;

b. a support bracket attached to one end of said tray means, said support bracket comprising:

i. first and second main support members extending generally perpendicular from said tray means, said first main support member extending from one side of said rear end of said tray means and said second main support member extending from the other side of said rear end of said tray means;

ii. first and second auxiliary support members extending from said first and second main support members, respectively, rearwardly of said rear end of said tray surface at a position so that the lower surfaces of said first and second auxiliary support members are generally coplanar with said tray means; and iii. a transverse support member extending from said rear end of said tray means in a direction opposite of said first and second main support members; and c. adjustable means cooperative with said first and second main support members for horizontally engaging the downwardly projecting lip of a shelf, said adjustable means being capable of adjustment for various spacing between shelves.

4. The auxiliary shelf apparatus according to claim 3 wherein said first and second main support members are connected at their free ends by a connector.

5. The auxiliary shelf apparatus according to claim 2 wherein said first and second main support members include adapter means, said adapter means being adjustable to different positions relative to said rear end of said tray means.

6. The auxiliary shelf apparatus according to claim 5 wherein said adapter means includes:

a. a collar positionable around said first and second main support members;

b. means for releasably positioning said collar along said first and second main support members; and c. a flange connected to said collar and spaced apart therefrom so as to form a channel therebetween for receiving a downwardly projecting lip of a shelf.

7. Auxiliary shelf apparatus according to claim 6 wherein said means for releasably positioning said collar with respect to said first and second main support members comprises a thumb screw which operatively engages one of said first and second main support members when tightened.

* * * * *